US011352940B1

(12) United States Patent
Gates et al.

(10) Patent No.: US 11,352,940 B1
(45) Date of Patent: Jun. 7, 2022

(54) LOCOMOTIVE FLUID HEATER CONTROL SYSTEM

(71) Applicant: Power Drives, Inc., Buffalo, NY (US)

(72) Inventors: Bradley Robert Gates, Erie, PA (US); Sean R. Jackson, Springboro, PA (US); Kevin W. O'Neal, Erie, PA (US)

(73) Assignee: Power Drives, Inc., Buffalo, NY (US)

( * ) Notice: Subject to any disclaimer, the term of this patent is extended or adjusted under 35 U.S.C. 154(b) by 0 days.

(21) Appl. No.: 17/141,713

(22) Filed: Jan. 5, 2021

(51) Int. Cl.

| | |
|---|---|
| ***F01P 7/16*** | (2006.01) |
| ***F01P 5/10*** | (2006.01) |
| ***F01P 5/04*** | (2006.01) |
| ***F01P 3/18*** | (2006.01) |

(52) U.S. Cl.
CPC ..... *F01P 7/167* (2013.01); *F01P 3/18* (2013.01); *F01P 5/04* (2013.01); *F01P 5/10* (2013.01); *F01P 2025/32* (2013.01); *F01P 2025/60* (2013.01)

(58) Field of Classification Search
CPC .... F01P 7/167; F01P 2025/32; F01P 2025/60; F01P 5/10; F01P 5/04; F01P 3/18
USPC ..... 123/41.02
See application file for complete search history.

(56) References Cited

U.S. PATENT DOCUMENTS

| | | | | |
|---|---|---|---|---|
| 2014/0239879 | A1* | 8/2014 | Madsen | B60L 53/14 320/104 |
| 2016/0046174 | A1* | 2/2016 | Sagou | H05B 3/12 219/202 |
| 2018/0023453 | A1* | 1/2018 | Okamura | F01P 7/165 123/142.5 E |

* cited by examiner

*Primary Examiner* — Joseph J Dallo
*Assistant Examiner* — Yi-Kai Wang
(74) *Attorney, Agent, or Firm* — Simpson & Simpson, PLLC

(57) ABSTRACT

A method of controlling a fluid heater control system for a locomotive, the fluid heater control system including a heater assembly including a water pump and a heating element, the method including determining if a fuel pump of the locomotive is on, if the fuel pump is off, activating the heater assembly, running the water pump for a first predetermined period of time, determining if a temperature of the fluid is greater than a first predetermined threshold, and if the temperature of the fluid is greater than the first predetermined threshold, deactivating the water pump for a second predetermined time period.

20 Claims, 5 Drawing Sheets

LOCOMOTIVE FLUID HEATER CONTROL SYSTEM

FIELD

The present disclosure relates to locomotive fluid heaters, and, more particularly, to fluid systems that heat internal components of locomotives, and even more particularly, to a system for controlling a locomotive fluid heater.

BACKGROUND

Generally, current locomotive designs utilize diesel engines. This is also true of other freight vehicles such as semi-trailer trucks and ships/boats. Locomotives and other vehicles, when off, require that engine components do not drop below a certain temperature so they can more easily start. For example, if the engine block of a semi-trailer truck drops below a certain temperature (e.g., 40° F.) in the winter, it will be difficult if not impossible to start until the engine components, and more importantly, the diesel fuel, reach a minimum start temperature. The same is true of locomotives. Thus, heating systems are utilized to help maintain a minimum engine temperature.

However, current locomotive heating systems require power fed directly from a grid (i.e., shore power), and thus cannot function unless docked at a terminal. Additionally, current locomotive heating systems require manual operation, that is, a user must manually turn the system on or off based on the current state of the locomotive (i.e., running or off) and the temperature of the ambient air and/or the engine, etc.

Thus, there has been a long-felt need for a locomotive fluid heater control system that does not require shore power connection and automatically controls the various components of the system to maintain a minimum temperature of the locomotive engine and/or locomotive battery charge.

SUMMARY

According to aspects illustrated herein, there is provided a method of controlling a fluid heater control system for a locomotive, the fluid heater control system including a heater assembly including a water pump and a heating element, the method comprising determining if a fuel pump of the locomotive is on, if the fuel pump is off activating the heater assembly, running the water pump for a first predetermined period of time, determining if a temperature of the fluid is greater than a first predetermined threshold, and if the temperature of the fluid is greater than the first predetermined threshold, deactivating the water pump for a second predetermined time period.

In some embodiments, the method further comprises, if the temperature of the fluid is less than or equal to the first predetermined threshold, activating the heating element, running the water pump, determining if the temperature of the fluid is greater than a second predetermined threshold, and if the temperature of the fluid is greater than the second predetermined threshold, deactivating the heating element. In some embodiments, the method further comprises, after the step of deactivating the heating element, running the water pump for a third predetermined time period. In some embodiments, the method further comprises, after the step of running the water pump for the third predetermined time period, deactivating the heater assembly. In some embodiments, the method further comprises, if the temperature of the fluid is less than or equal to the first predetermined threshold, activating the heating element, running the water pump, determining if the temperature of the fluid is greater than a second predetermined threshold, and if the temperature of the fluid is less than or equal to the second predetermined threshold, repeating the step of running the water pump. In some embodiments, the method further comprises determining if a battery of the locomotive is low, and if the battery is low, deactivating the heater assembly. In some embodiments, the method further comprises sending a signal to a remote location indicating that the battery is low. In some embodiments, the method further comprises determining if the locomotive is connected to a power source external to the grid, and if the locomotive is connected to the power source, activating a battery charger to charge the battery. In some embodiments, the second predetermined threshold is greater than the first predetermined threshold.

According to aspects illustrated herein, there is provided a system for controlling a fluid heater control system for a locomotive, comprising a heater assembly including a water pump and a heating element, one or more processors, one or more readable storage media, and program instructions stored on the readable storage media for execution by at least one of the one or more processors, the program instructions comprising program instructions to determine if a fuel pump of the locomotive is on, program instructions to, if the fuel pump is off run the water pump for a first predetermined period of time, program instructions to determine if a temperature of the fluid is greater than a first predetermined threshold, and program instructions to, if the temperature of the fluid is greater than the first predetermined threshold, deactivate the water pump for a second predetermined time period.

In some embodiments, the program instructions further comprise program instructions to, if the temperature of the fluid is less than or equal to the first predetermined threshold, activate the heating element, program instructions to run the water pump, program instructions to determine if the temperature of the fluid is greater than a second predetermined threshold, and program instructions to, if the temperature of the fluid is greater than the second predetermined threshold, deactivate the heating element. In some embodiments, the program instructions further comprise program instructions to, after the program instructions to deactivate the heating element, run the water pump for a third predetermined time period. In some embodiments, the program instructions further comprise program instructions to, before the program instructions to run the water pump for a first predetermined period of time, activate the heater assembly. In some embodiments, the program instructions further comprise program instructions to, after the program instructions to run the water pump for the third predetermined time period, deactivate the heater assembly. In some embodiments, the program instructions further comprise program instructions to, if the temperature of the fluid is less than or equal to the first predetermined threshold, activate the heating element, program instructions to run the water pump, program instructions to determine if the temperature of the fluid is greater than a second predetermined threshold, and program instructions to, if the temperature of the fluid is less than or equal to the second predetermined threshold, repeat the step of running the water pump. In some embodiments, the program instructions further comprise program instructions to determine if a battery of the locomotive is low, and program instructions to, if the battery is low, deactivate the heater assembly. In some embodiments, the program instructions further comprise program instructions to send a signal to a remote location indicating that the battery is low. In some embodiments, the program instructions further comprise program instructions to determine if the locomotive is connected to a power source external to the grid, and program instructions to, if the locomotive is connected to the power source, activate the battery charger to charge the battery. In some embodiments, the second predetermined threshold is greater than the first predetermined threshold.

According to aspects illustrated herein, there is provided a method of controlling a fluid heater control system for a locomotive, the fluid heater control system including a heater assembly including a water pump and a heating element, the method comprising determining if a fuel pump of the locomotive is on, if the fuel pump is off, running the water pump for a first predetermined period of time, determining if a temperature of the fluid is greater than a first predetermined threshold, if the temperature of the fluid is less than or equal to the first predetermined threshold, activating the heating element, running the water pump, determining if the temperature of the fluid is greater than a second predetermined threshold, if the temperature of the fluid is greater than the second predetermined threshold, deactivating the heating element, and running the water pump for a third predetermined time period.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
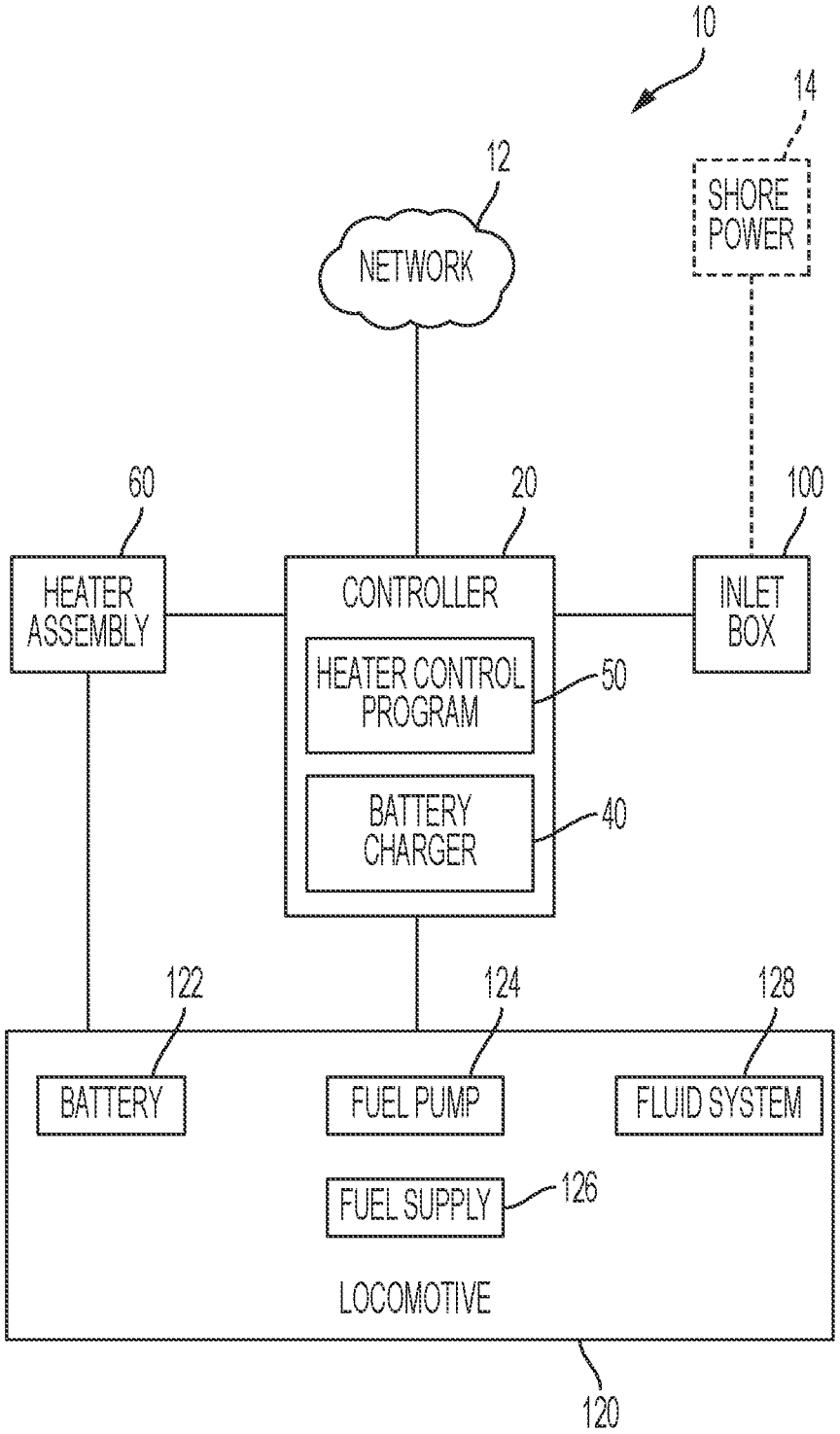
FIG. 1 is a functional block diagram illustrating a locomotive fluid heater control system.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Adverting now to the figures, FIG. 1 is a functional block diagram illustrating locomotive fluid heater control system 10. FIG. 1 provides only an illustration of one implementation, and does not imply any limitations with regard to the environments in which different embodiments may be implemented. Many modifications to the depicted environment may be made by those skilled in the art without departing from the scope of the disclosure as recited by the claims. In some embodiments, locomotive fluid heater control system, or control system 10, comprises controller 20 and heater assembly 20 and is operatively arranged to implemented on locomotive 120. In some embodiments, control system 10 further comprises inlet box 100 operatively arranged to connect to shore power or building power (power source) 14. As is known in the art, shore power is the provision of electrical power to a locomotive while its main and auxiliary engines are shut down. For example, when a locomotive is stopped at a terminal, the term "shore power" denotes the ability of the locomotive to plug into grid power when parked for idle reduction. In some embodiments, control system 10 further comprises network 12 and/or a computing device. In some embodiments, control system 10 further comprises a processor or microprocessor (i.e., a chip that resides in computers and other electronic devices to receive input and provide the appropriate output, as is known to those skilled in the art).

Network 12 can be, for example, a local area network (LAN), a wide area network (WAN) such as the Internet, or a combination of the two, and can include wired, wireless, or fiber optic connections. Network 12 may, for example, interact with gateway 34 (see FIG. 2B). Gateway 34 is operatively arranged to send and receive communications to a remote location. For example, gateway 34 is capable if sending communications to a remote location indicating that battery 122 is low, an error has occurred in control system 10, a status of shore power (e.g., shore power is connected and whether the source is 120 V or 240V), etc. Network 12 may also interact with gateway 34 and/or circuit boards 24 to program controller 20.

Locomotive 120 generally comprises battery 122, fuel pump 124, fuel supply 126, and fluid system 128.

Battery or batteries 122 are utilized by locomotive 120 as an auxiliary power source. For example, battery 122 may be used to start or help start up the locomotive, to power the locomotive lights, for power outlets within the train, etc. In some embodiments, battery-powered locomotives may be used to operate the train. Both controller 20 and heater assembly 60 are connected to battery 122, as will be described in greater detail below.

Fuel pump 124 provide fuel to the engine of locomotive. Fuel pump 124 is operatively arranged to communicate with controller 20. Specifically, when locomotive 120 is started, fuel pump 124 is activated. Controller 20 receives a signal from fuel pump 124 indicating that fuel pump 124, and thus locomotive 120, is on. This triggers controller 20 to shut down heater assembly 60, as will be described in greater detail below. In some embodiments, the signal from fuel pump 124 is continuous as long as fuel pump 124 is on. When fuel pump 124 is shut off (i.e., when locomotive 120 is turned off), the signal ceases and controller 20 turns on heater assembly 60.

Fuel supply 126 supplies fuel to locomotive 120 via a fuel pump 124. Fuel supply 126 also supplies fuel to heater assembly 60, via a fuel pump in heating unit 68, specifically, heating element 76. As such, heater assembly 60, specifically, heating unit 68, is connected to fuel supply 126 and/or fuel pump 124, as will be described in greater detail below.

Fluid system 128 comprises water or coolant and is arranged to run fluid (e.g., water or coolant) through locomotive 120 in order to maintain a temperature throughout the engine and other components. During times of low temperature (e.g., winter), it is important to maintain the engine at a certain temperature (e.g., 100° F.). Similarly, it is important to prevent locomotive 120 getting too hot. Fluid system 128 circulates water or coolant through the locomotive engine block and cooling system to maintain a temperature throughout. Fluid system 128 is connected to heater assembly 60, as will be described in greater detail below.

Figure 2A:
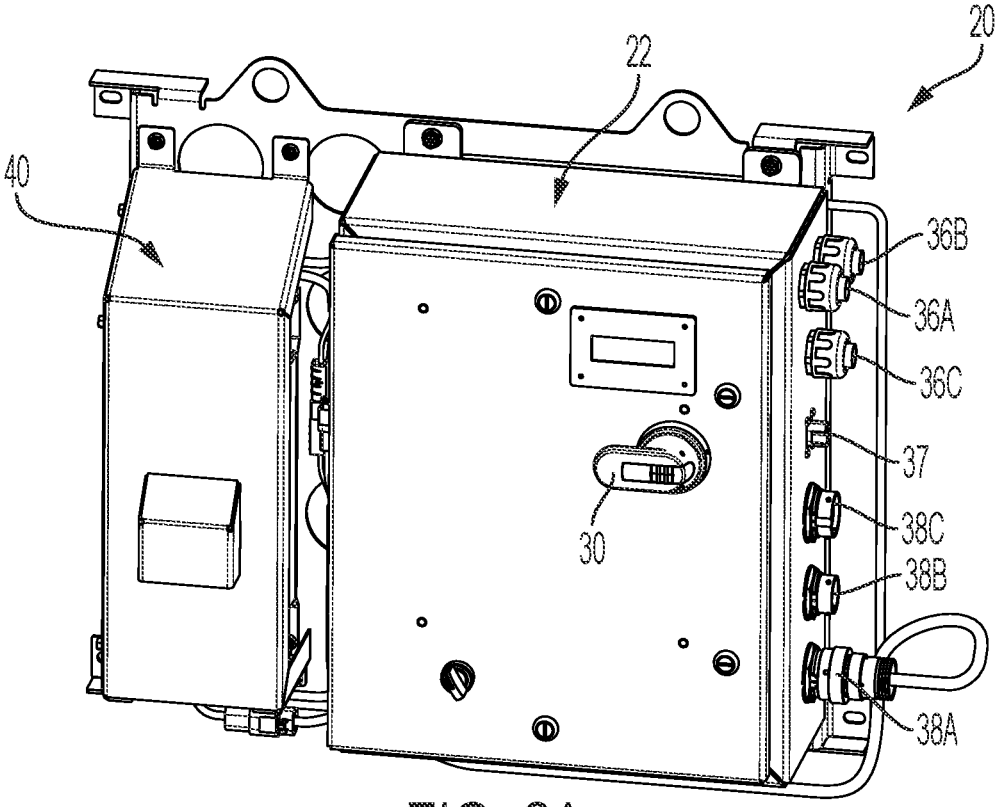
FIG. 2A is perspective view of a controller.
Figure 2B:
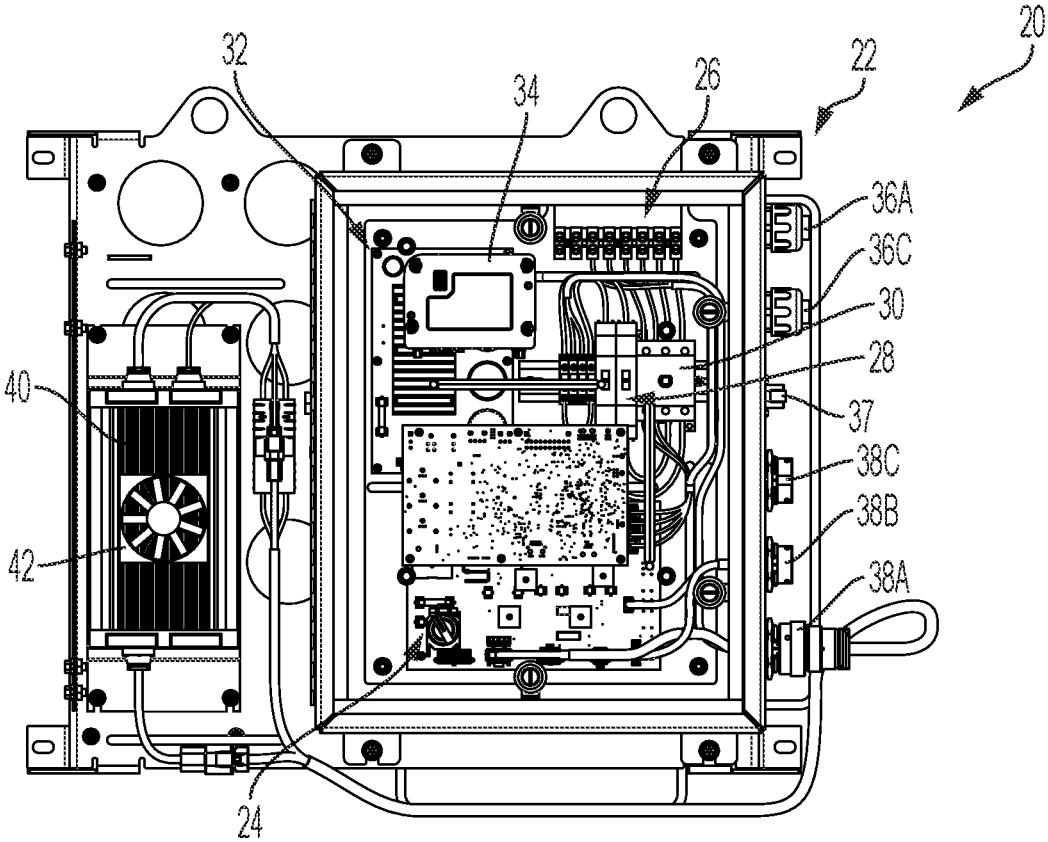
FIG. 2B is a front elevational view of the controller shown in FIG. 3A.

FIG. 2A is perspective view of controller 20. FIG. 2B is a front elevational view of controller 20. Controller 20 comprises control panel 22 and battery charger 40. Controller 20 (i.e., control panel 22) is a hardware device that controls control system 10 and is capable of automatically maintaining the temperature of fluid system 128 and/or the charge of battery 122 using heater control program 50. Control panel 22 is operatively arranged to control heater assembly 60, battery charger 40, and fluid system 128. In some embodiments, controller 20 may include a computer or computing device. In some embodiments, controller 20 further comprises a processor or microprocessor. In some embodiments, control program 50 is implemented on a web server, which ay be a management server, or web server, or any other electronic device or computing system capable of receiving and sending data. The web server can represent a computing system utilizing clustered computers and components to act as a single pool of seamless resources when accessed through a network.

Control panel 22 generally comprises one or more circuits or circuit boards 24, terminal 26, direct current (DC) to DC power supply 32, and gateway 34. In some embodiments, heater control program 50 is programmed into circuit boards 24 (i.e., circuit boards 24 are programmable circuit boards). Control panel 22 further comprises one or more circuit breakers 28 and switch 30. A power source (e.g., shore power through inlet box 100 or battery power from battery 122) is connected to terminal 26. DC to DC power supply 32 regulates the power from inlet box 100 and/or battery 122 by reducing the input voltage down to a voltage suitable for use by circuit boards 24, heating element 76, gateway 34, and/or battery charger 40. For example, in some embodiments, DC to DC power supply 32 steps the voltage from locomotive battery 122 down to 24 VDC. In some embodiments, element 32 is a voltage or power regulator. Circuit breakers 28 and switch 30 are connected to terminal 26. Circuit boards 24 are connected to circuit breakers 28 and switch 30. Circuit boards 24 may comprise one or more processors (e.g., microcontrollers). It should be appreciated that controller 20 may comprise a computing device including memory and storage. Switch 30 is the main disconnect switch for both alternating current (AC) shore power 14 and power from locomotive battery 122.

In some embodiments, controller 20 comprises one or more ports, for example, ports 36A-C, port 37, and ports 38A-C. In some embodiments, ports 36A-C are conduit connections for shore power 14 (for example through inlet box 100), locomotive battery 122, and signal from locomotive fuel pump 124. In some embodiments, port 37 is a connector for an external indicator light. The external indicator light can be mounted on locomotive 20 (e.g., to the exterior of locomotive 20) and shows the system status. For example, the external indicator light may have green, red, and yellow indicator colors indicating various statuses of controller 20, heater assembly 60, fuel pump 124, inlet box 100 (i.e., the presence of shore power 14), etc. In some embodiments, and as shown, port 38A connects battery charger 40 to control panel 22. In some embodiments, port 38B is a connector for an optional air compressor module. In some embodiments, port 38C is a connector for heater assembly 60.

Heater control program 50 receives communicates with fuel pump 124 indicating whether locomotive 120 is running and is capable of activating and deactivating the components of heater assembly 60 (e.g., water pump 62, heating unit 68, heating element 76) depending thereon. In this regard, heater control program 50 is capable of automatically controlling fluid system 128 and the temperature thereof according to predetermined criteria, as will be described in greater detail below with respect to FIG. 5. Heater control program 50 is capable of detecting a current charge in battery 122 and communicating such status with a remote location (i.e., sending a communication indicating that the charge battery 122 is low). Heater control program 50 is capable of detecting connection to shore power 14 and activating battery charger 40 to charge battery 122. Heater control program 50 can generally include any software capable of communicating with heater assembly 60, locomotive 120, inlet box 100, and network 12 to maintain a temperature of locomotive 120, maintain a charge in battery 122, activate and deactivating various components of control system 10 based on a current status of the respective component, and send signals to remote locations.

Battery charger 40 is connected to control panel 22 and battery 122. Battery charger 40 is operatively arranged to charge battery 122 when locomotive 120 is connected to shore power 14. Battery charger 40 receives power from inlet box 100 (from grid) via control panel 22, and uses that power to charge battery 122 (e.g., trickle charge). When locomotive 120 is not connected to shore power 14, battery charger 40 does not charge battery 122. In some embodiments, battery charger 40 comprises cooling fan 42 and a plurality of fins in order to dissipate heat from charger 40 and maintain a suitable temperature.

Figure 3:
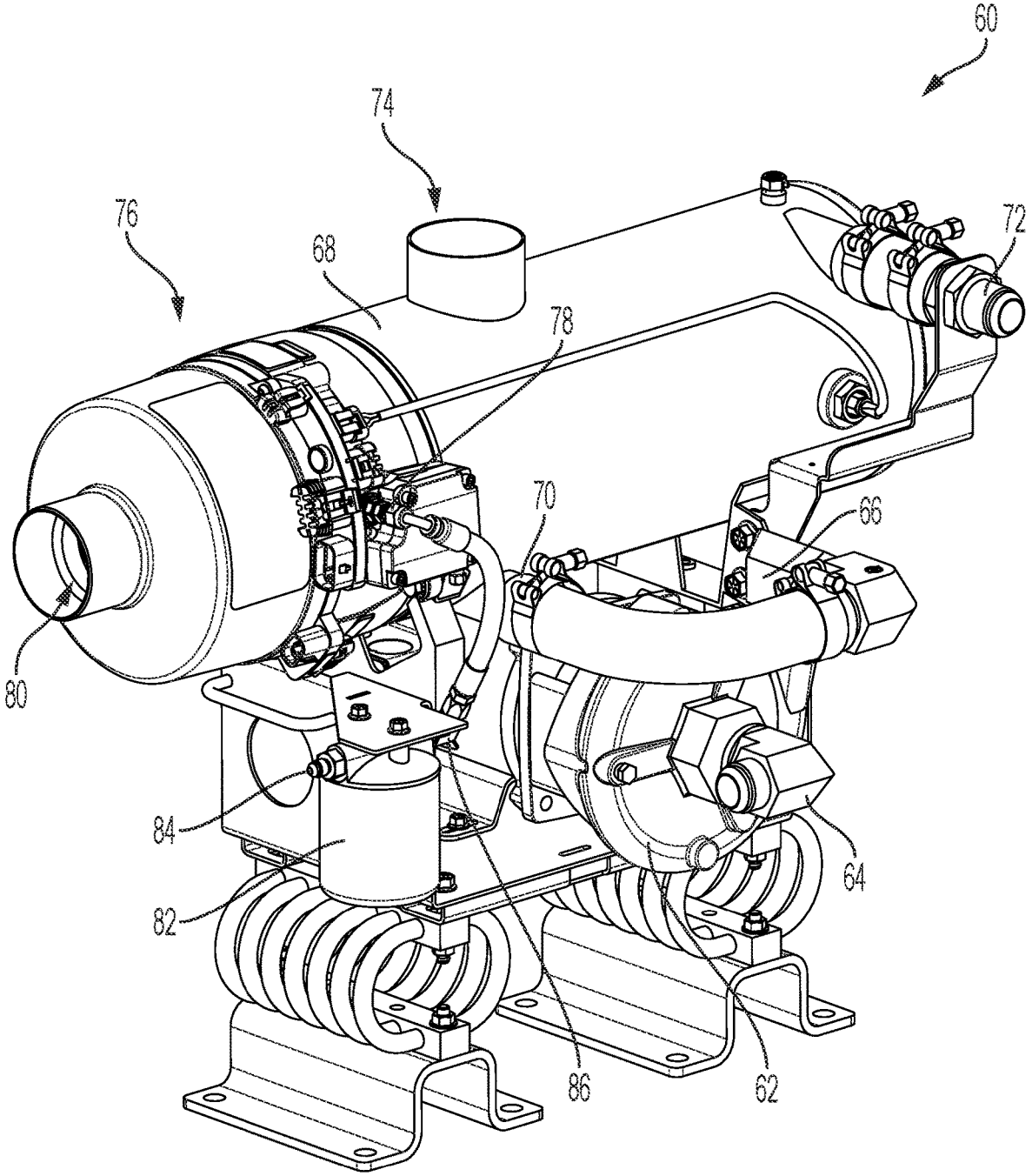
FIG. 3 is a perspective view of a heater assembly.

FIG. 3 is a perspective view of heater assembly 60. Heater assembly 60 comprises water pump 62, heating unit 68, and fuel filter 82. In some embodiments, heater assembly 60 is electrically connected to battery 122 through controller 20.

Water pump 62 comprises inlet 64 connected to fluid system 128 and outlet 66 connected to heating unit 68 at inlet 70. Water pump 62 pumps fluid (e.g., water, coolant, etc.) from fluid system 128 to/through heating unit 68 and back to fluid system 128. In some embodiments, water pump 62 comprises a MP Pumps 27667, Series 60 Standard End Suction Centrifugal Pump. In some embodiments, water pump 62 comprises a 3/4 HP Leeson 2500 RPM 56C TEFC 90 VDC MOTOR 098009.00. Water pump 62 is electrically connected to controller 20. Specifically, controller 20 is arranged to activate and deactivate water pump 62.

Heating unit 68 comprises inlet 70 connected to outlet 66 of water pump, outlet 72 connected to fluid system 128, and heating element 76. Fluid is pumped through heating unit 68 via water pump 62. Heating element 76 comprises inlet 78 and is operatively arranged to heat the fluid passing through heating unit 68. Fuel is pumped (e.g., via fuel pump 124 or an additional fuel pump) from fuel supply 126 through fuel filter 82 to inlet 78 of heating element 76. Heating element 76 burns the fuel to heat the fluid. In some embodiments, heating unit 68 further comprises exhaust 74 and combustion air inlet 80. Heater assembly 60 is electrically connected to controller 20. Specifically, controller 20 is arranged to activate and deactivate heating unit 68 (i.e., heating element 76). Heater assembly 60, namely, heating unit 68 further comprises a temperature sensor that is operatively arranged to detect the temperature of the fluid passing through heating unit 68. Controller 20 communicates with the temperature sensor to detect the temperature of the fluid.

Figure 4A:
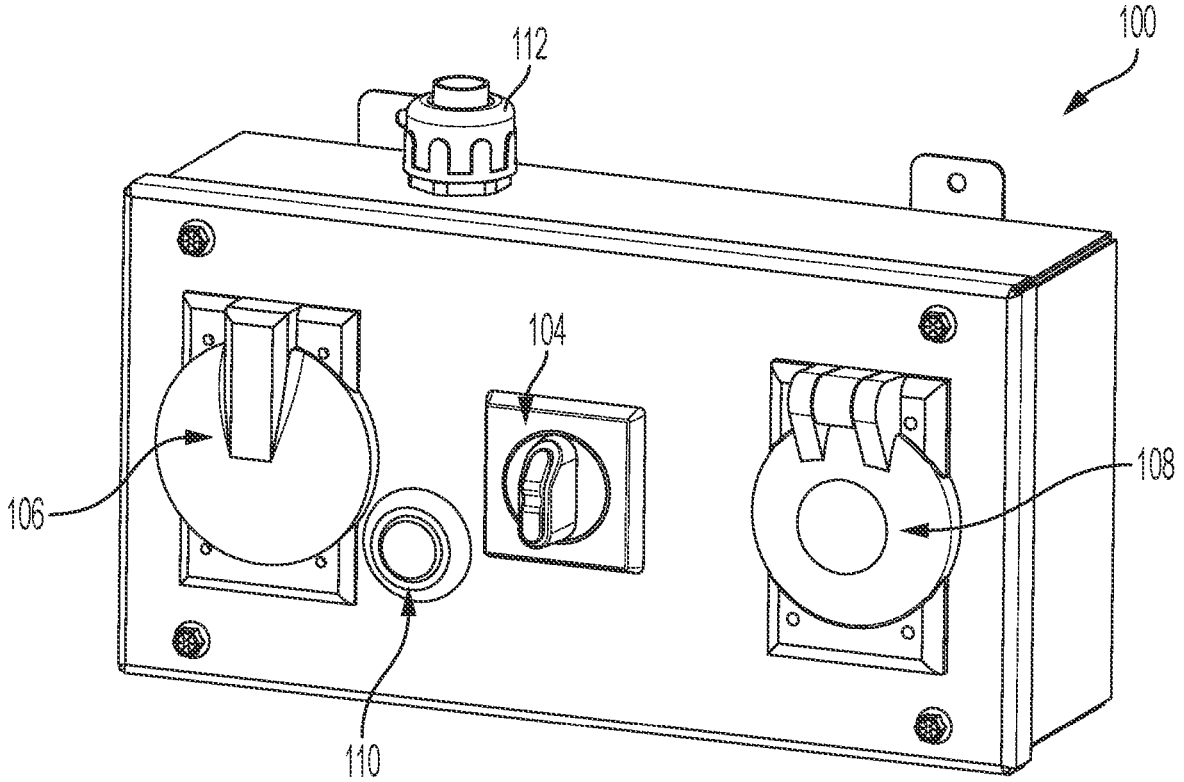
FIG. 4A is a perspective view of an inlet box.
Figure 4B:
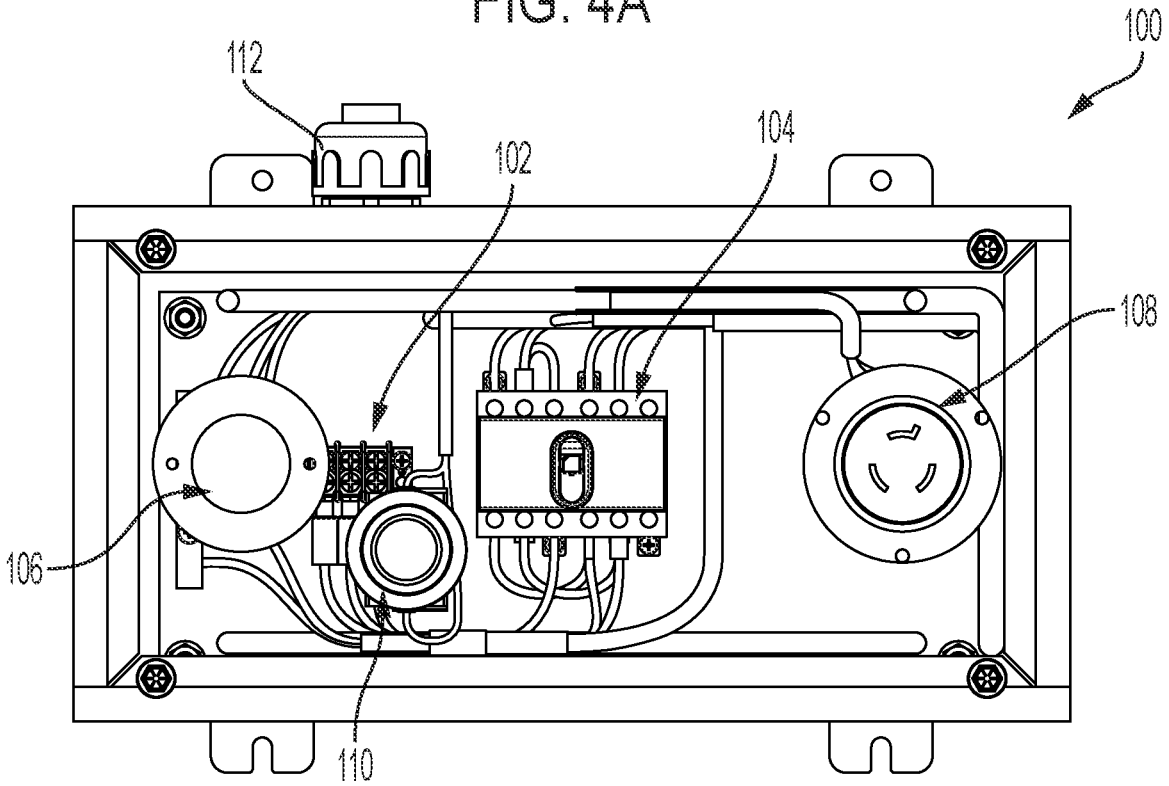
FIG. 4B is a front perspective view of the inlet box shown in FIG. 4A; and, FIG. 5 is a flow chart depicting operational steps for controlling a locomotive fluid heating system.

FIG. 4A is a perspective view of inlet box 100. FIG. 4B is a front perspective view of inlet box 60. Inlet box 100 generally comprises terminal 102, switch 104, socket 106, socket 108, indicator light 110, and one or more ports, for example, port 112. Inlet box 100 is arranged to be electrically connected to controller 20. For example, a cable or wire(s) may be, at a first end, fed through port 112 and connected to terminal 102 and, at a second end, fed through port 36A and connected to terminal 26. Sockets 106 and 108 are connected to switch 104 and terminal 102. In some embodiments, one of sockets 106 and 108 is a 120 V socket and the other of sockets 106 and 108 is a 240 V socket. Switch 104 is operatively arranged to direct power from one of sockets 106 and 108 to terminal 102, or prevent power to terminal 102 from sockets 106 and 108. For example, in a first position, as shown in FIG. 4A, switch 104 prevents any power to terminal 102 from both of sockets 106 and 108 (i.e., in an off state). If switch 104 is turned in a first circumferential direction from the off state, power is allowed to flow from socket 106 to terminal 102, and thus controller 20. If switch 104 is turned in a second circumferential direction from the off state, opposite the first circumferential direction, power is allowed to flow from socket 108 to terminal 102, and thus controller 20. For example, if the shore power 14 comprises a 240 V connection, the shore power 14 connector is connected to socket 108 and switch 104 is turned in the second circumferential direction, thus allowing shore power to controller 12. If shore power 14 comprises a 120 V connection, the shore power 14 connector is connected to socket 106 and switch 104 is turned in the first circumferential direction, thus allowing shore power to controller 12. Furthermore, when switch 104 is turned to an on state (i.e., when rotated either in the first circumferential direction or the second circumferential direction to allow power to terminal 102 and thus controller 20), indicator light 110 activates. When switch is turned to the off state, indicator light 110 deactivates.

When inlet box 100 is connected to shore power 14 and switch 104 is in an on state, or more specifically, when controller 20 receives power from inlet box 100, controller 20 activates battery charger 40 to charge battery 122. When shore power 14 is disconnected from shore power or switch 104 is in an off state, controller 20 deactivates battery charger 40.

Figure 5:
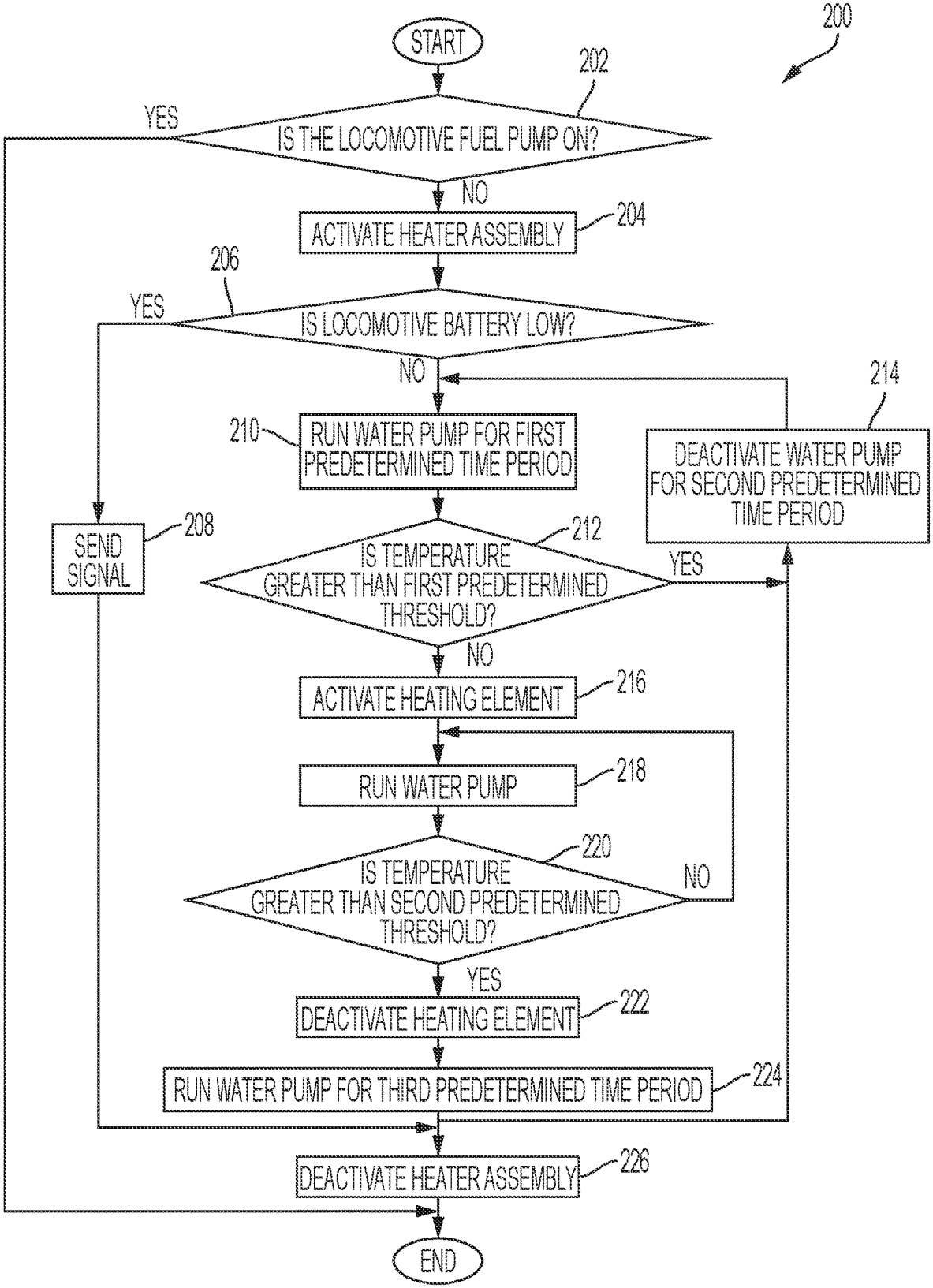

FIG. 5 illustrates flow chart 200 depicting operational steps for controlling a locomotive fluid heating system.

In step 202, heater control program 50 determines if locomotive fuel pump 124 and/or locomotive 120 is running. As previously described, in some embodiments, fuel pump 124 sends a continuous signal to controller 20 when it is on, indicating that locomotive is on. It should be appreciated that when locomotive 120 fuel pump 124 is activated as locomotive 120 requires fuel to operate. Thus, if fuel pump 124 is on, so is locomotive 120. When locomotive 120 is turned off or deactivated, so is fuel pump 124 and the continuous signal ceases. In some embodiments, controller receives a single signal from fuel pump 124 when fuel pump 124 is turned on, and a single signal from fuel pump 124 when fuel pump 124 is turned off.

If, in step 202, heater control program 50 determines that locomotive fuel pump 124 is on, then the program ends.

If, in step 202, heater control program 50 determines that locomotive fuel pump 124 is off, then in step 204 heater control program 50 activates heater assembly 60. By activate it is meant that power is provided to heater assembly 60 and/or heater assembly 60 is initiated or turned on.

In step 206, heater control program 50 determines if locomotive battery 122 is low. Heater control program 50 is capable of measuring the current charge in battery 122. In this step, heater control program 50 determines whether the current charge in battery 122 is less than a predetermined threshold, which would indicate that it is low.

If, in step 206, heater control program 50 determines that locomotive battery 122 is low, then in step 208 heater control program 50 sends a signal to a remote location, for example via gateway 34, indicating a low charge in batter 122. Then, in step 226, heater control program 50 deactivates heater assembly 60.

If, in step 206, heater control program 50 determines that locomotive battery 122 is not low (i.e., the current charge is greater than or equal to the predetermined threshold), then in step 210 heater control program 50 runs water pump 62 for a first predetermined period of time. By run it is meant that water pump 62 pumps fluid from fluid system 128, through heating unit 68, and back to fluid system 128. In some embodiments, the first predetermined period of time is two minutes.

In step 212, heater control program 50 determines if the temperature of the fluid is greater than a first predetermined threshold. Controller 20 communicates with the temperature sensor of heating unit 68 to detect the temperature of the fluid flowing therethrough. In some embodiments, the first predetermined threshold is 90° F.

If, in step 212, heater control program 50 determines that the temperature of the fluid is greater than the first predetermined threshold, then in step 214 heater control program 50 deactivates water pump 62 for a second predetermined period of time. Then the process restarts at step 210. In some embodiments, the second predetermined time period is fifteen minutes.

If, in step 212, heater control program 50 determines that the temperature of the fluid is less than or equal to the first predetermined threshold, then in step 216 heater control program 50 activates heating element 76. Controller 20 activates heating element 76 in order to increase the temperature of the fluid flowing through heating unit 68.

In step 218, heater control program 50 runs water pump 62. In some embodiments, in step 218, water pump 62 may be run indefinitely until a temperature of the fluid is reached or water pump 62 may be run for a predetermined period of time.

In step 220, heater control program 50 determines if the temperature of the fluid is greater than a second predetermined threshold. Controller 20 communicates with the temperature sensor of heating unit 68 to detect the temperature of the fluid flowing therethrough, all the while heating element 76 is activated. In some embodiments, the second predetermined threshold is different than the first predetermined threshold. For example, the second predetermined threshold may be greater than the first predetermined threshold. In some embodiments, the second predetermined threshold is 110° F.

If, in step 220, heater control program 50 determines that the temperature of the fluid is less than or equal to the second predetermined threshold, then the process repeats at step 218 (i.e., water pump 62 runs indefinitely until heater control program 50 determines that the temperature of the fluid is greater than the second predetermined threshold).

If, in step 220, heater control program 50 determines that the temperature of the fluid is greater than the second predetermined threshold, then in step 222 heater control program 50 deactivates heating element 76. By deactivate it is meant that heating element 76 is turned off such that the temperature of the fluid is no longer increased by heating unit 68 and fuel is no longer being utilized by heating unit 68.

In step 224, heater control program 50 runs water pump 62 for a third predetermined period of time. After heating element 76 is deactivated in step 222, it is desired to remove some of the heat from the heat exchanger (i.e., heating unit 68). This is accomplished by pumping fluid through heating unit 68 with heating element 76 disabled. In some embodiments, the third predetermined period of time is three minutes.

In step 226, heater control program 50 deactivates heater assembly 60. It should be appreciated that instead of deactivating heater assembly 60 in step 226, heater control program 50 may proceed back to step 214, and deactivate water pump 62 for the second predetermined time period (e.g., fifteen minutes). Subsequently, in step 210, heater control program 50 runs water pump 62 for the first predetermined time period (e.g., two minutes) and proceeds through flow chart 200 accordingly.

In some embodiments, in an additional step, heater control program 50 determines if inlet box 100 is connected to shore power 14 and/or if controller 20 is receiving power from inlet box 100. If heater control program 50 determines that controller 20 is receiving power from inlet box 100, then heater control program 50 activates battery charger 40 to charge battery 122.

It should be appreciated that flowchart 200 may run continuously, over and over again, from step 202 through step 226. Additionally, and as previously described, flowchart 200 may run continuously from step 210 through step 224. In some embodiments, steps 204 and 226 of flowchart 200 are removed.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Locomotive fluid heater control system
12 Network
14 Shore or grid or building power (power source)
20 Controller
22 Control panel
24 Circuit boards
26 Terminal
28 Circuit breakers
30 Switch
32 Direct current to direct current power supply (voltage/power regulator)
34 Gateway
36A Port
36B Port
36C Port
37 Port
38A Port
38B Port
38C Port
40 Battery charger
42 Fan
50 Heater control program
60 Heater assembly

62 Water pump
64 Inlet
66 Outlet
68 Heating unit
70 Inlet
72 Outlet
74 Exhaust
76 Heating element
78 Inlet
80 Exhaust
82 Fuel filter
84 Inlet
86 Outlet
100 Inlet box
102 Terminal
104 Switch
106 Socket
108 Socket
110 Indicator light
112 Port
200 Flow chart
202 Step
204 Step
206 Step
208 Step
210 Step
212 Step
214 Step
216 Step
218 Step
220 Step
222 Step
224 Step
226 Step

What is claimed is:

1. A method of controlling a fluid heater control system for a locomotive, the fluid heater control system including a heater assembly including a water pump and a heating element, the method comprising:

determining if a fuel pump of the locomotive is on;

if the fuel pump is off, activating the heater assembly;

running the water pump for a first predetermined period of time;

determining if a temperature of the fluid is greater than a first predetermined threshold; and, if the temperature of the fluid is greater than the first predetermined threshold, deactivating the water pump for a second predetermined time period.

2. The method as recited in claim 1, further comprising:

if the temperature of the fluid is less than or equal to the first predetermined threshold, activating the heating element;

running the water pump;

determining if the temperature of the fluid is greater than a second predetermined threshold; and, if the temperature of the fluid is greater than the second predetermined threshold, deactivating the heating element.

3. The method as recited in claim 2, further comprising:

after the step of deactivating the heating element, running the water pump for a third predetermined time period.

4. The method as recited in claim 3, further comprising:

after the step of running the water pump for the third predetermined time period, deactivating the heater assembly.

5. The method as recited in claim 2, further comprising:

if the temperature of the fluid is less than or equal to the first predetermined threshold, activating the heating element;

running the water pump;

determining if the temperature of the fluid is greater than a second predetermined threshold; and, if the temperature of the fluid is less than or equal to the second predetermined threshold, repeating the step of running the water pump.

6. The method as recited in claim 1, further comprising:

determining if a battery of the locomotive is low; and, if the battery is low, deactivating the heater assembly.

7. The method as recited in claim 6, further comprising:

sending a signal to a remote location indicating that the battery is low.

8. The method as recited in claim 6, further comprising:

determining if the locomotive is connected to a power source external to the grid; and, if the locomotive is connected to the power source, activating a battery charger to charge the battery.

9. The method as recited in claim 2, wherein the second predetermined threshold is greater than the first predetermined threshold.

10. A system for controlling a fluid heater control system for a locomotive, comprising:

a heater assembly including a water pump and a heating element;

one or more processors;

one or more readable storage media; and, program instructions stored on the readable storage media for execution by at least one of the one or more processors, the program instructions comprising:

program instructions to determine if a fuel pump of the locomotive is on;

program instructions to, if the fuel pump is off, run the water pump for a first predetermined period of time;

program instructions to determine if a temperature of a fluid is greater than a first predetermined threshold; and, program instructions to, if the temperature of the fluid is greater than the first predetermined threshold, deactivate the water pump for a second predetermined time period.

11. The system as recited in claim 10, wherein the program instructions further comprise:

program instructions to, if the temperature of the fluid is less than or equal to the first predetermined threshold, activate the heating element;

program instructions to run the water pump;

program instructions to determine if the temperature of the fluid is greater than a second predetermined threshold; and, program instructions to, if the temperature of the fluid is greater than the second predetermined threshold, deactivate the heating element.

12. The system as recited in claim 11, wherein the program instructions further comprise:

program instructions to, after the program instructions to deactivate the heating element, run the water pump for a third predetermined time period.

13. The system as recited in claim 12, wherein the program instructions further comprise:

program instructions to, before the program instructions to run the water pump for a first predetermined period of time, activate the heater assembly.

14. The system as recited in claim 13, wherein the program instructions further comprise:

program instructions to, after the program instructions to run the water pump for the third predetermined time period, deactivate the heater assembly.

15. The system as recited in claim 10, wherein the program instructions further comprise:

program instructions to, if the temperature of the fluid is less than or equal to the first predetermined threshold, activate the heating element;

program instructions to run the water pump;

program instructions to determine if the temperature of the fluid is greater than a second predetermined threshold; and, program instructions to, if the temperature of the fluid is less than or equal to the second predetermined threshold, repeat the step of running the water pump.

16. The system as recited in claim 10, wherein the program instructions further comprise:

program instructions to determine if a battery of the locomotive is low; and, program instructions to, if the battery is low, deactivate the heater assembly.

17. The system as recited in claim 16, wherein the program instructions further comprise:

program instructions to send a signal to a remote location indicating that the battery is low.

18. The system as recited in claim 16, further comprising a battery charger, wherein the program instructions further comprise:

program instructions to determine if the locomotive is connected to a power source external to the grid; and, program instructions to, if the locomotive is connected to the power source, activate the battery charger to charge the battery.

19. The system as recited in claim 12, wherein the second predetermined threshold is greater than the first predetermined threshold.

20. A method of controlling a fluid heater control system for a locomotive, the fluid heater control system including a heater assembly including a water pump and a heating element, the method comprising:

determining if a fuel pump of the locomotive is on;

if the fuel pump is off, running the water pump for a first predetermined period of time;

determining if a temperature of a fluid is greater than a first predetermined threshold;

if the temperature of the fluid is less than or equal to the first predetermined threshold, activating the heating element;

running the water pump;

determining if the temperature of the fluid is greater than a second predetermined threshold;

if the temperature of the fluid is greater than the second predetermined threshold, deactivating the heating element; and, running the water pump for a second predetermined time period.

* * * * *